US011624198B2

(12) United States Patent
Clarey

(10) Patent No.: US 11,624,198 B2
(45) Date of Patent: Apr. 11, 2023

(54) PUMP UNIT

(71) Applicant: Scott Clarey, Fitzroy (AU)

(72) Inventor: Scott Clarey, Fitzroy (AU)

( * ) Notice: Subject to any disclaimer, the term of this patent is extended or adjusted under 35 U.S.C. 154(b) by 0 days.

(21) Appl. No.: 17/308,564

(22) Filed: May 5, 2021

(65) Prior Publication Data

US 2021/0348412 A1 Nov. 11, 2021

Related U.S. Application Data

(60) Provisional application No. 63/020,569, filed on May 6, 2020.

(51) Int. Cl.
*E04H 4/12* (2006.01)
*E04H 4/00* (2006.01)

(52) U.S. Cl.
CPC ..... *E04H 4/12* (2013.01); *E04H 4/0043* (2013.01)

(58) Field of Classification Search
CPC ..... E04H 4/12
USPC ..... 4/507, 509
See application file for complete search history.

(56) References Cited

U.S. PATENT DOCUMENTS 4,907,304 A * 3/1990 Davidson ..... A63B 69/125 4/488
5,207,729 A * 5/1993 Hatanaka ..... A61H 33/6063 4/492
6,030,180 A * 2/2000 Clarey ..... A63B 69/125 417/18
8,607,372 B2 * 12/2013 Hall ..... E04H 4/005 4/507
10,960,282 B2 * 3/2021 Hsu ..... E04H 4/14
2015/0295397 A1 * 10/2015 Lin ..... E04H 4/0006 4/491
2017/0216697 A1 * 8/2017 Cameron ..... F04F 5/12

* cited by examiner

*Primary Examiner* — Christine J Skubinna
(74) *Attorney, Agent, or Firm* — Welsh Flaxman & Gitler LLC

(57) ABSTRACT

A pump unit for a prefabricated swimming pool, the unit having a pump wall panel and a mount connected to or integral with the pump wall panel. There is also a pump located or locatable at the mount. The arrangement is such that when the pump unit is in use the pump is able to drive a current of water through the pump wall panel into a pool sufficient to enable on the spot swimming inside the pool.

8 Claims, 5 Drawing Sheets

PUMP UNIT

CROSS REFERENCE TO RELATED APPLICATION

This application claims the benefit of U.S. Patent Application Ser. No. 63/020,569, entitled "A PUMP UNIT," filed May 6, 2020, which is incorporated herein by reference.

FIELD OF THE INVENTION

This invention relates to a pump unit, for example a pump unit for generating a current in a body of water. The water may be that of a swimming pool.

BACKGROUND

It is known to form a prefabricated swimming pool with a pump to generate a water current that a human user can swim against. While swimming naturally, the user does not travel forward because this is resisted by the force of the current. In effect the user is swimming in one spot, which is commonly referred as "on the spot swimming". This enables users to swim for recreation, exercise, or sports training, without needing a long length pool. It is known to connect the pump to the pool wall so that water can pass through the wall toward and away from the pump. However, it can be cumbersome and labour intensive to fit a pump in this way, and the arrangement can be prone to water leaks in the area where the pump connects to the pool wall.

OBJECT OF THE INVENTION

It is desirable for the componentry of pools as described above to allow for efficient installation, and to minimise the risk of leaks. It is an object of a preferred embodiment of the invention to go at least some way toward facilitating this. While preferred embodiments of the invention may have particular advantages or benefits, these should not be read as limitations on any claims expressed more broadly. The object of the invention per se is simply to provide consumers with a useful choice.

INTERPRETATION

The term "comprising" or derivatives thereof such as "comprises" when used in this document in relation to a combination of features should not be interpreted exclusively. In other words the terms indicate the minimum features present, without ruling out the option of additional unspecified features. The 'features' may for example be physical items and/or action steps.

SUMMARY OF THE INVENTION

According to one aspect the invention comprises a pump unit for a prefabricated swimming pool comprising:

- a pump wall panel;
- a mount connected to or integral with the pump wall panel; and
- a pump located or locatable at the mount and being such that when in use it is able to drive a current of water through the pump wall panel into a pool sufficient to enable on the spot swimming inside the pool.

Optionally the pump wall panel has an intake portion to enable water to be drawn in through the pump wall panel and a discharge portion to enable water to be expelled out through the pump wall panel.

Optionally the mount comprises a main body portion arranged to hold the pump level when the body portion is in its normal in-use disposition.

Optionally the mount comprises a series of ground engaging legs.

Optionally concrete embeds the legs of the mount to assist in keeping the pump unit securely in place.

Optionally, the mount and the pump wall panel are a common moulding. In preferred embodiments this serves to minimise the risk of water from a pool leaking out, i.e. because there are fewer joins available for egress of water Optionally the pump wall panel has or is associated with a waterproof membrane that prevents water leaking behind the pump wall panel and membrane when the pump unit is fitted into that wall. The waterproof membrane is such that it can be cut to have openings complimentary to the panel's intake and discharge portions.

Optionally the pump wall panel is adapted to form, or forms, part of the wall of a prefabricated swimming pool.

Optionally at least part of the pump is within a tube or shroud that can be slid into the rest of the unit.

According to a further aspect of the invention there is a pump unit for a prefabricated swimming pool comprising:

- a pump wall panel;
- a mount extending from and behind the pump wall panel; and
- a pump located or locatable at the mount and being such that when in use it is able to drive a current of water through the pump wall panel into a pool;

the pump unit being such that at least the pump wall panel and the mount are prefabricated and unitary to provide a ready to install combination.

DRAWINGS

Some preferred embodiments of the invention will now be described by way of example and with reference to the accompanying drawings, of which:

DETAILED DESCRIPTION

Figure 1:
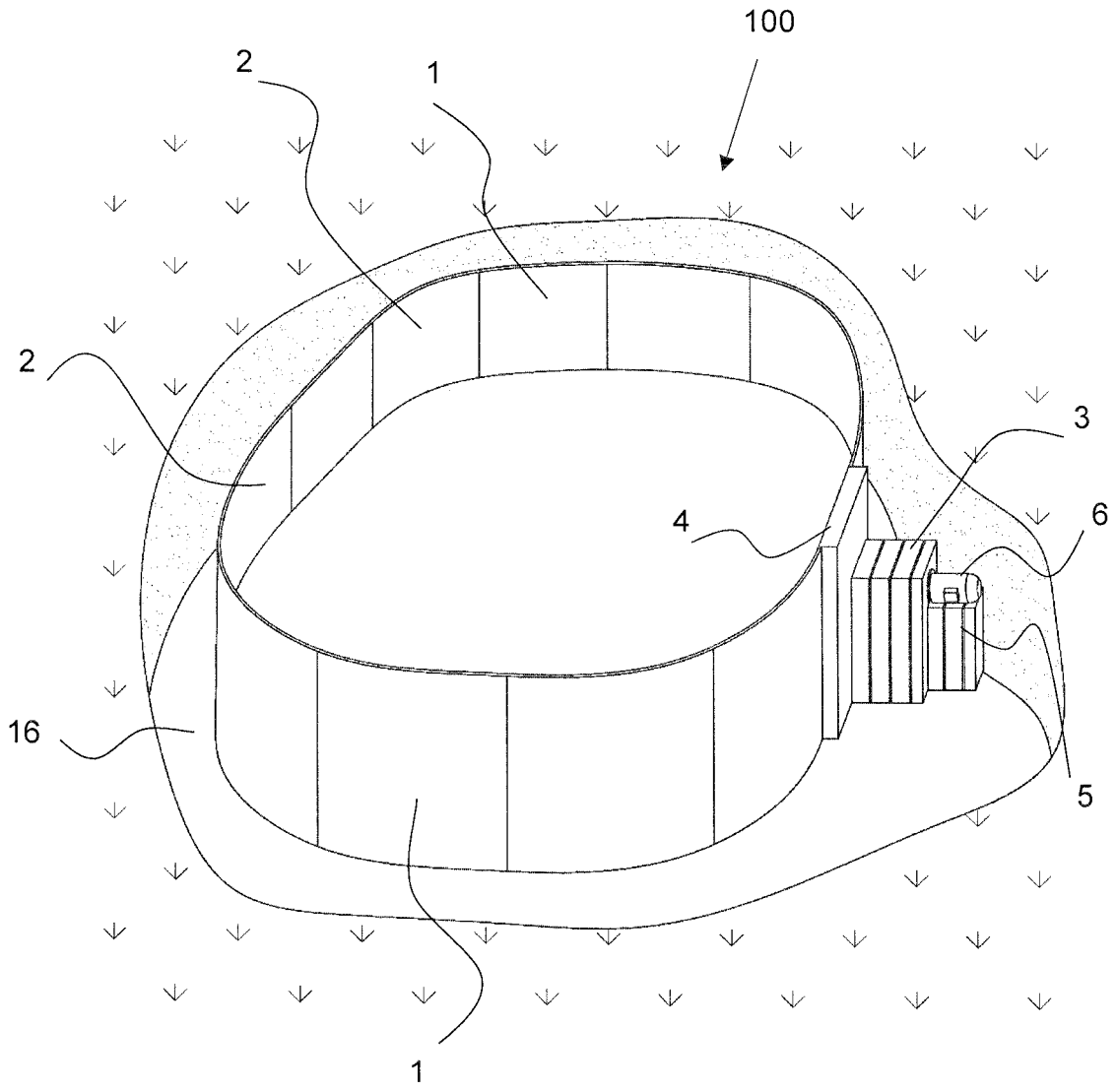
FIG. 1 is an isometric view showing a prefabricated swimming pool partially formed.

Referring to FIG. 1, a prefabricated swimming pool 100 is produced by forming a cavity 16 in the ground and creating a wall 1 by arranging a series of pool wall panels 2 within the cavity 16. A pump unit 3, which has a pump wall panel 4, a mount 5, and a pump 6, is fitted with the wall 1. Only the externally positioned motor 6*c* of the pump 6 is shown in FIG. 1, the other components being within the mount 5. The arrangement is such that the pump wall panel 4 becomes part of the wall 1, i.e. it fits in between a pair of neighboring pool wall panels 2 and connects to them to form part of the prefabricated swimming pool 100. As indicated, the mount 5 and pump 6 are on the outside of the wall 1 of the pool 100.

Figure 2:
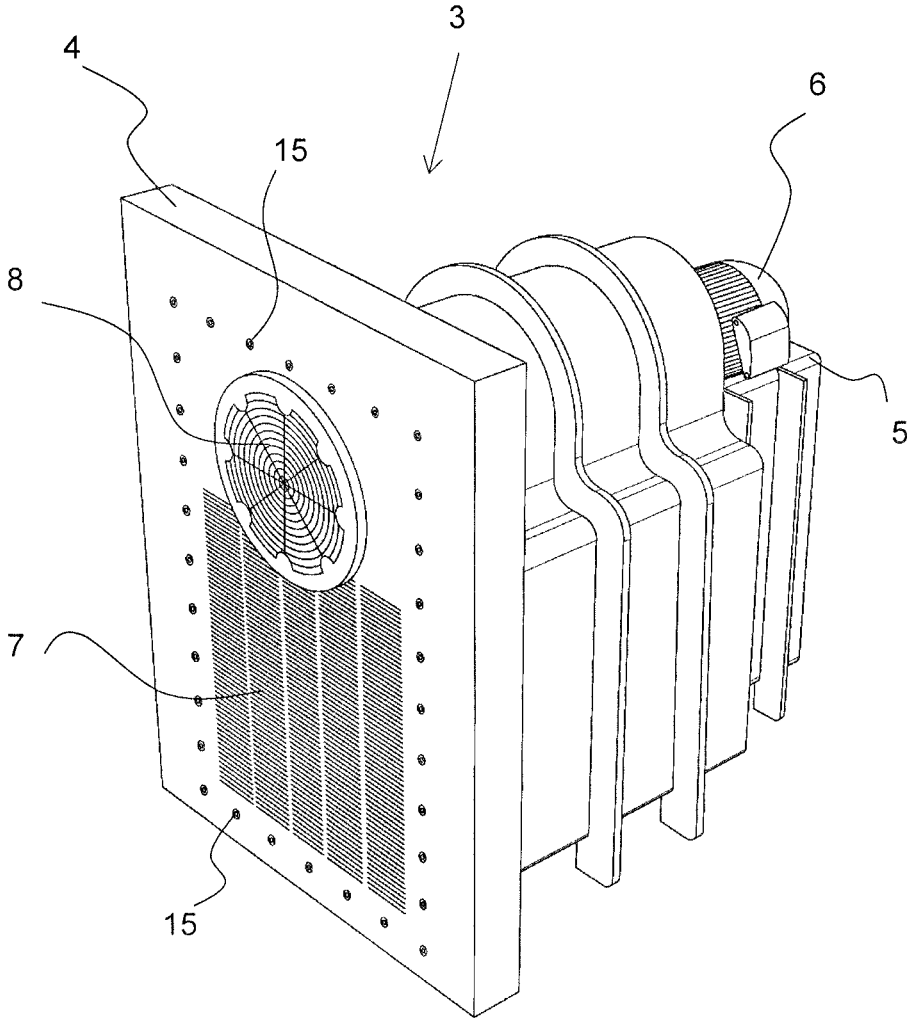
FIG. 2 is an isometric view of a pump unit that forms part of the pool.
Figure 3:
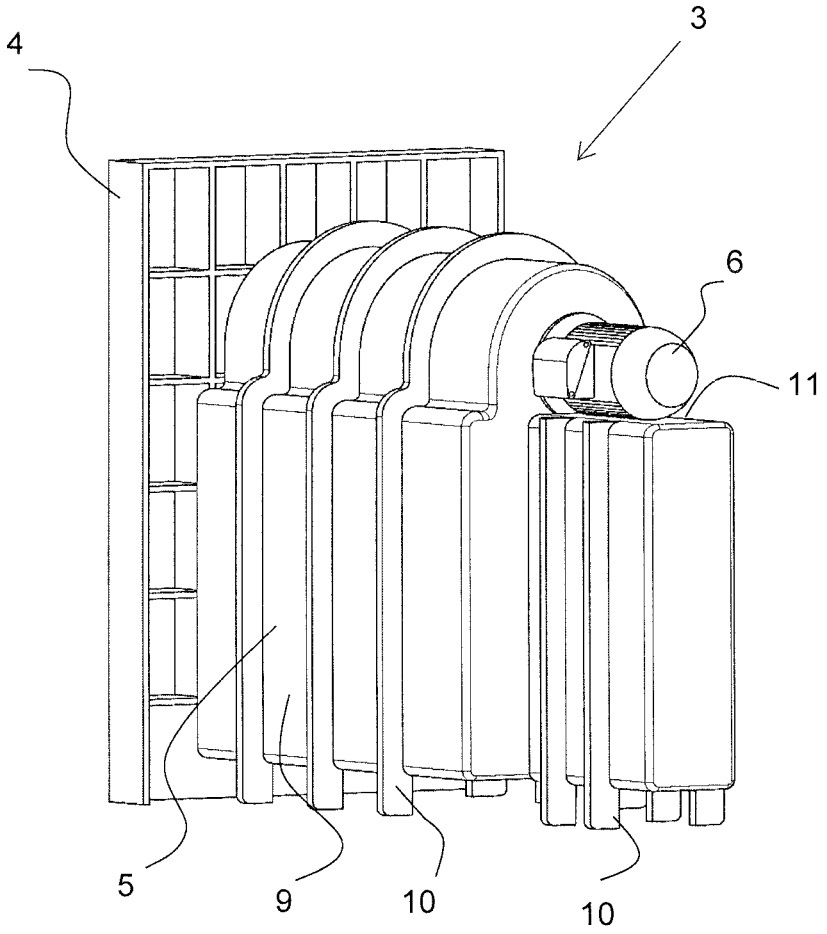
FIG. 3 is an alternative isometric view of the pump unit.

Referring to FIGS. 2-3, the pump unit 3 has a water intake 7 (with multiple openings) and a water discharge 8 (also with multiple openings). In each case these are grate-like but may take an alternative form if desired. As depicted, the intake 7 is significantly larger than the discharge 8. The arrangement is such that water is drawn in through the intake 7 and then driven back out through the discharge 8, in each case due to pressure exerted by the pump 6. Preferably the water intake 7 and discharge 8 comprise part of (e.g., openings in) the unit's pump wall panel 4. The water is driven out at significantly greater pressure than it is taken in, to generate a current sufficient to provide resistance against a swimmer or other user of the pool 100. In other words the current is sufficient for a user to swim into naturally without actually moving forward. Preferably the current is adjustable by changing settings of the pump 6. As shown, the mount 5 has a central main body portion 9 incorporating a series of rib-like, ground engaging legs 10, and a ledge 11 that holds the pump 6 level. Preferably the pump 6 is secured so it cannot move longitudinally or laterally.

Figure 4:
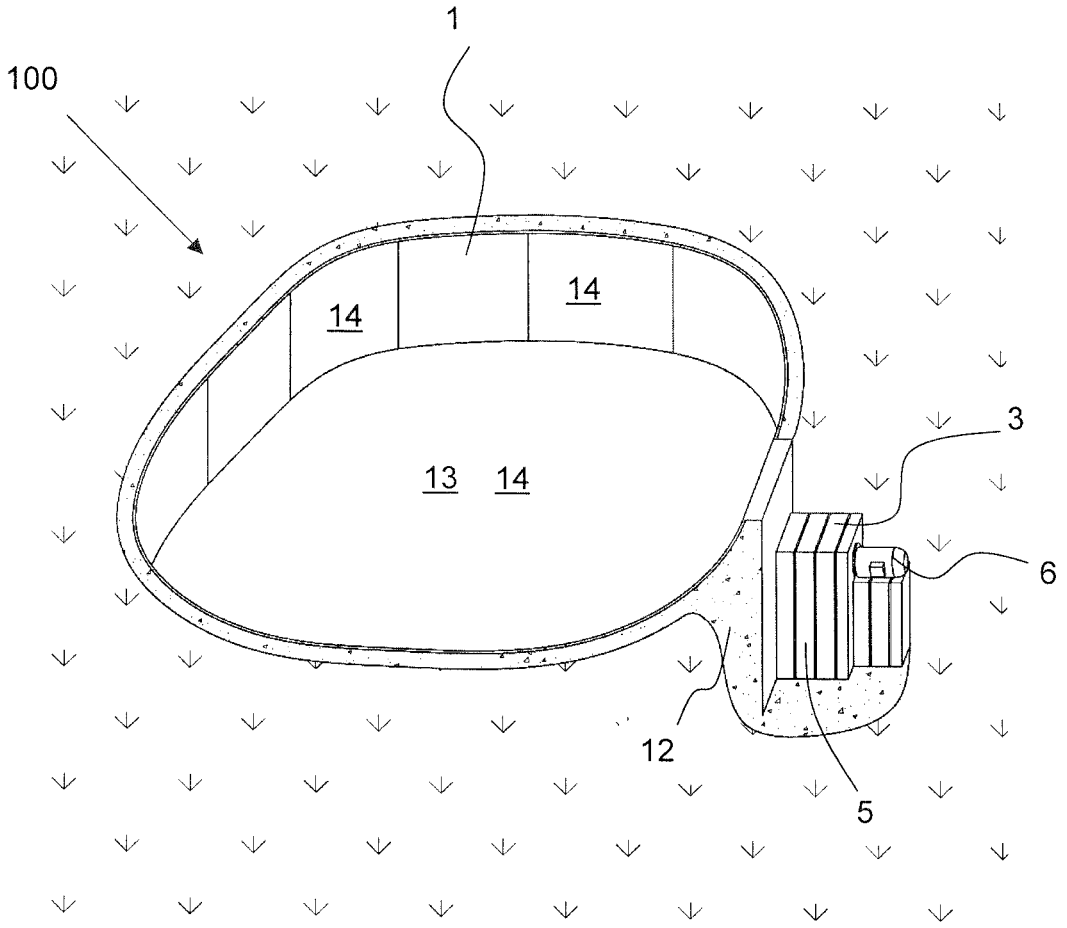
FIG. 4 illustrates the pool at a substantially finished stage.

Referring to FIG. 4, concrete 12 is poured on the outside of the pool wall 1 and allowed to cure. In this sense the wall 1 provides formwork for the concrete. Concrete 12 is also poured over the bottom of the cavity 13 to provide a floor for the pool 100. The concrete 12 embeds the legs 10 of the mount 5 to keep it securely in place, but does not go very far up the sides of the mount 5, i.e. it stops well below the level of the pump 6. A waterproof membrane 14 is applied over both the wall 1 and over the concrete floor base 13 to stop water escaping when the pool 100 is filled. Preferably the waterproof membrane 14 is comprised of a vinyl polymer. The waterproof membrane 14 is cut away at the water intake 7 and the water discharge 8 (not visible in FIG. 4) so as not to interfere with movement of water towards and away from the pump 6. Preferably a gasket (not shown) is used between the perimeter of the cut-out space of the waterproof membrane 14 and the pump unit 3 to prevent pool water leaking out. Referring back to FIG. 2, the waterproof membrane 14 and gasket may be secured to the pump wall panel 4 by way of fasteners applied to perimeter holes 15 around the intake 7 and the discharge 8.

Figure 5:
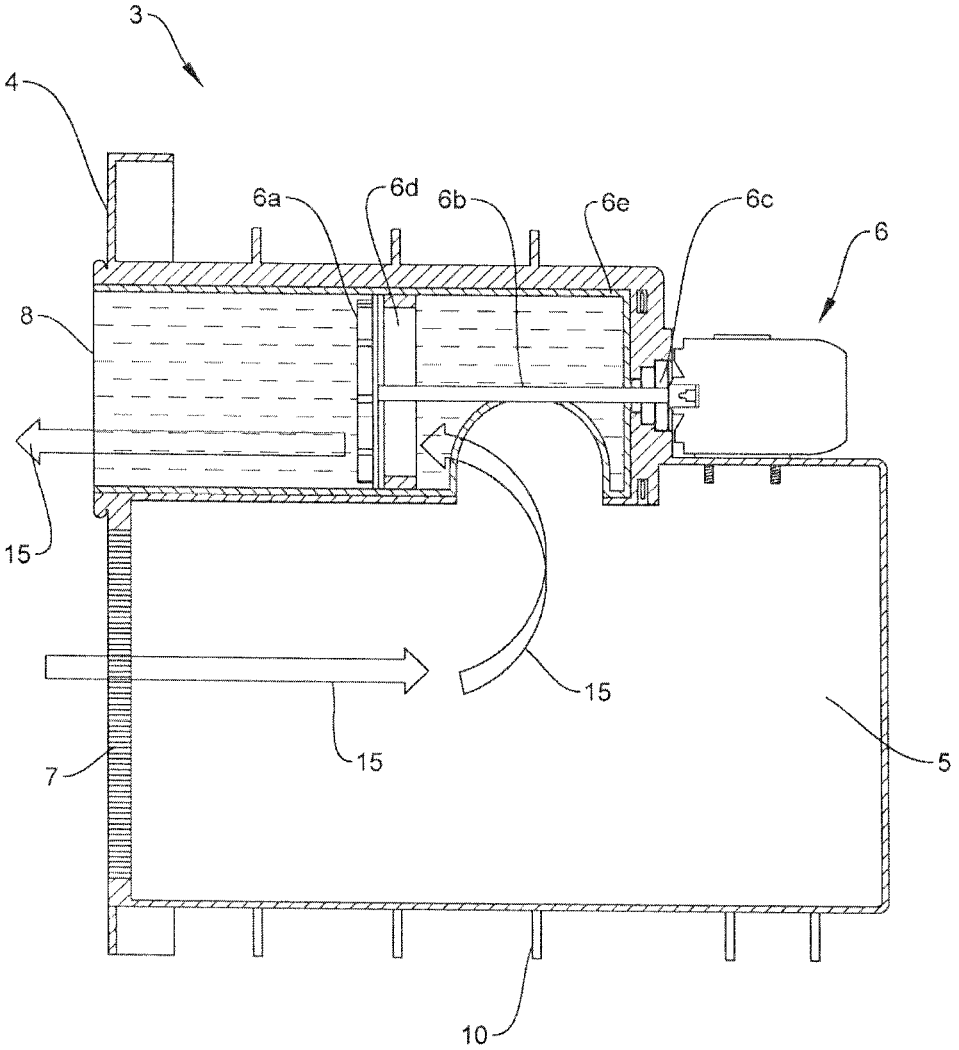
FIG. 5 is a cross sectional side view of the pump unit and pump.

FIG. 5 illustrates some internal parts of the pump unit 3, and in particular the pump 6 that receives water from the water intake means and discharges water via the water discharge means to produce a current in the water in the swimming pool 100. The flow path of water through the unit 3 is indicated by the arrows 15. As shown, the pump 6 comprises an impeller 6*a* for driving the water, a drive shaft 6*b* extending from the impeller to the external motor 6*c*, and a holder 6*d* arranged to support the drive shaft 6*b*. The pump 6 also comprises a tubular shroud 6*e* that can be slid into the central body 6*f* when arranging the pump 6.

The pump unit 3 is such that its pump wall panel 4 and the mount 5 are plastics moulded from a common mould. Put another way, they may be co-moulded so as to be unitary and ready to install as a combination. The preferred types of plastic are thermoplastics or plastic polymers. Optionally, fiber-reinforced plastic such as fiberglass may be used. Optionally the pump's mechanics are fitted within a shroud or casing that is a common moulding with the pump unit 3, although this is not necessary. Optionally the pump's mechanics are within a tubular shroud that can be slid into the rest of the pump unit.

In preferred embodiments, moulding of the pump unit 3 involves roto-moulding, injection moulding, compression moulding, or thermoforming.

While the pool is preferably formed in a cavity in the ground as above, in alternative embodiments the pool can be made as an above ground panel pool, otherwise made the same way as described above, for example by incorporating the pump unit 3 into a pool wall. In that case the pour of concrete around the wall formed by the panels may be omitted.

In terms of the 'disclosure', this document contemplates any feature or step mentioned herein in combination with one or more of any of the other features or steps mentioned herein. This applies regardless of whether such a feature, step or combination of any of these is claimed.

While some preferred embodiments of the invention have been described by way of example it should be appreciated that modifications and improvements can occur without departing from the scope of the following claims.

The invention claimed is:

1. A pump unit for a prefabricated swimming pool having a series of pool wall panels comprising:

a pump wall panel which connects between neighboring pool wall panels to form part of the prefabricated swimming pool;

the pump wall panel has with an intake portion to enable water to be drawn in through the pump wall panel and a discharge portion to enable water to be expelled out through the pump wall panel;

a pump mount connected to the pump wall panel; and a pump connected to the pump mount such that when in use the pump is able to drive a current of water through the pump wall panel into a pool sufficient to enable on the spot swimming inside the pool.

2. A pump unit according to claim 1, wherein the pump mount comprises a main body portion arranged to hold the pump level when the main body portion is in its normal in-use disposition.

3. A pump unit according to claim 1, wherein the pump mount comprises a series of ground engaging legs.

4. A pump unit according to claim 3, wherein concrete embeds the legs of the pump mount to assist in keeping the pump securely in place.

5. A pump unit according to claim 1, wherein the pump mount and the pump wall panel are a common moulding.

6. A pump unit according to claim 1, wherein the pump wall panel has a waterproof membrane that prevents water leaking between the pump wall panel and a surrounding pool wall when the pump unit is fitted into that pump wall panel.

7. A pump unit according to claim 1, wherein at least part of the pump is within a tube or shroud that can be slid into the rest of the unit.

8. A pump unit according to claim 1, wherein the pump mount is integral with the pump wall panel.

* * * * *